US008925733B2

(12) United States Patent
Guenther

(10) Patent No.: US 8,925,733 B2
(45) Date of Patent: Jan. 6, 2015

(54) SCREEN ELEMENT FOR A DISC SCREEN DEVICE

(75) Inventor: Bernd Guenther, Wartenberg (DE)

(73) Assignee: Guenther Holding GmbH & Co. KG, Wartenberg (DE)

( * ) Notice: Subject to any disclaimer, the term of this patent is extended or adjusted under 35 U.S.C. 154(b) by 73 days.

(21) Appl. No.: 13/816,314

(22) PCT Filed: Jul. 20, 2011

(86) PCT No.: PCT/EP2011/062429
§ 371 (c)(1),
(2), (4) Date: Feb. 11, 2013

(87) PCT Pub. No.: WO2012/022574
PCT Pub. Date: Feb. 23, 2012

(65) Prior Publication Data

US 2013/0139336 A1 Jun. 6, 2013

(30) Foreign Application Priority Data

Aug. 19, 2010 (DE) ..... 10 2010 037 073

(51) Int. Cl.
*B07B 1/14* (2006.01)
*A46B 15/00* (2006.01)
*B07B 1/15* (2006.01)
*B07B 1/52* (2006.01)

(52) U.S. Cl.
CPC . *A46B 15/00* (2013.01); *B07B 1/15* (2013.01); *B07B 1/528* (2013.01)
USPC ..... 209/671

(58) Field of Classification Search
USPC ..... 209/379, 385, 389, 671, 672, 931
See application file for complete search history.

(56) References Cited

U.S. PATENT DOCUMENTS

| | | | | |
|---|---|---|---|---|
| 1,418,899 | A * | 6/1922 | Acken | 209/671 |
| 5,590,792 | A * | 1/1997 | Kobayashi | 209/667 |
| 6,037,004 | A | 3/2000 | Zajchowski et al. | |
| 6,241,100 | B1 * | 6/2001 | Tanner et al. | 209/671 |
| 6,250,477 | B1 * | 6/2001 | Swanink | 209/386 |
| 6,318,560 | B2 * | 11/2001 | Davis | 209/672 |
| 8,522,983 | B2 * | 9/2013 | Davis | 209/672 |
| 8,640,880 | B2 * | 2/2014 | Farwick | 209/671 |
| 8,646,615 | B2 * | 2/2014 | Bruggencate et al. | 209/667 |
| 8,800,781 | B1 * | 8/2014 | Carlile et al. | 209/671 |
| 8,827,083 | B2 * | 9/2014 | Doppstadt et al. | 209/672 |
| 2011/0303587 | A1 | 12/2011 | Doppstadt et al. | |

FOREIGN PATENT DOCUMENTS

| | | | |
|---|---|---|---|
| DE | 10 2007 042518 | A1 | 3/2009 |
| DE | 20 2008 016913 | U1 | 5/2010 |
| EP | 0 925 845 | A2 | 6/1999 |
| GB | 2 268 867 | A | 1/1994 |

* cited by examiner

*Primary Examiner* — Joseph C Rodriguez
(74) *Attorney, Agent, or Firm* — Panitch Schwarze Belisario & Nadel LLP

(57) ABSTRACT

The invention relates to a screen element (1) for a disc screen device which has a plurality of rotable shafts (2, 3) oriented parallel to one another, on each of which a plurality of screen elements (1) that are spaced axially from one another are non-rotationally arranged, wherein the screen element (1) has elastically flexible fingers (4). The screen element is implemented such that at least one of the fingers is designed as a cleaning finger (5) free of reinforcement for cleaning in particular the collar (6) of a screen element (1) arranged on the neighboring axis of rotation (2, 3).

17 Claims, 2 Drawing Sheets

SCREEN ELEMENT FOR A DISC SCREEN DEVICE

CROSS-REFERENCE TO RELATED APPLICATIONS

This application is a national stage application (under 35 U.S.C. §371) of PCT/EP2011/062429, filed Jul. 20, 2011, which claims benefit of German application 10 2010 037 073.8, filed Aug. 19, 2010.

TECHNICAL FIELD AND STATE OF THE ART

The invention relates to a screen element for a disc screen device that has a plurality of axes of rotation oriented parallel to one another, on each of which a plurality of screen elements that are spaced axially from one another are non-rotatably arranged, whereby the screen element has elastically flexible fingers.

European patent specification EP 1 088 599 B1 discloses a rotation screen element of the above-mentioned type that is configured as a screen star. The prior-art screen stars have elastically flexible fingers, whereby in or on at least one finger, there is a reinforcement part whose radial extension is greater than its axial extension, whereby the reinforcement part has a maximum width that matches the width of the finger, and whereby the radial extension of the finger is smaller than the radial extension of the reinforcement part. The reinforcement part is configured and intended to move repeatedly over the collar of adjacent rotation screen elements during the screening procedure. This prevents dirt or foreign matter from accumulating on the collar, so that a continuous cleaning takes place during the actual screening procedure.

The reinforcement part has to first be manufactured as a separate component having very precise dimensions, and in another step, it then has to be attached to or in one of the cleaning fingers. Here, too, strict requirements are made in terms of the precision. The multi-stage manufacturing process of the screen element is thus complicated and expensive.

German patent application DE 10 2007 042 518 A1 describes an eccentric screen element for disk screens. The screen element is configured as a screen star and it has an eccentric geometry or eccentric outer contour with respect to its axis of rotation. In this screen element, a cleaning element configured as a reinforcement part is provided on one of the fingers. According to a special configuration of this screen element, the cleaning element is arranged on the star finger whose free end is at the greatest radial distance from the axis of rotation.

It is an objective of the present invention to put forward a screen element for a disc screen device that provides a cleaning function, especially for the collar of a screen element arranged on an adjacent axis of rotation, and that can be made more simply and thus also more cost-effectively.

SUMMARY OF THE INVENTION

This objective is achieved by a screen element that is characterized in that at least one of the fingers is configured as a cleaning finger that is free of reinforcement parts for purposes of cleaning especially the collar of a screen element that is arranged on the adjacent axis of rotation and/or on one adjacent axis of rotation.

Among other things, the invention is based on the idea of not fitting one of the fingers of the screen element with a reinforcement element that functions as a cleaning device, but instead, of configuring the finger itself as a cleaning finger.

Here, in the manner according to an embodiment of the invention, there was first a need to overcome the preconceived notion that it is not necessary for all of the fingers to be the same, especially to be made of the same material, but rather that one finger of the screen element for a disc screen device, at least partially, can be made of a different material and/or can have another shape and/or size than the other fingers. This should be viewed before the backdrop of the fact that the prior-art screen elements have always been made in one piece and of a uniform material.

Moreover, it has been recognized according to the invention that, in order to configure a cleaning finger, there is a need to at least partially relinquish the requirement that the individual fingers have to be elastic.

Accordingly, in one special embodiment, the screen element according to the invention has at least one cleaning finger that, at least at its radial end, is made of a different material from that of the rest of the screen element and/or from that of the other fingers. In particular, it can be provided that the at least one cleaning finger, at least at its radial end, is made of an abrasion-proof material.

In an especially advantageous embodiment, it is provided that the at least one cleaning finger, at least at its radial end, is made of an abrasion-proof plastic, especially of polyimide and/or of polyvinyl chloride and/or of polyester urethane rubber, or else of a mixture of abrasion-proof plastics.

As an alternative, it can also be provided that the at least one cleaning finger, at least at its radial end, is made of a metal, or of a metal alloy, especially of steel and/or of tempered steel and/or of fine-grained steel and/or of Hardox and/or of Creusabro.

In another embodiment according to the invention, the at least one cleaning finger, at least at its radial end, is made of a ceramic material.

The abrasion-proof configuration of at least the radial end of the cleaning finger ensures that the cleaning finger can be used at least for an acceptable period of time, preferably as long as the other fingers have not become worn out.

In an especially advantageous embodiment, the cleaning finger is or can be fastened to the rest of the screen element in such a way that it can be removed and/or replaced. This embodiment has the special advantage that a worn-out cleaning finger can be replaced without having to replace the entire screen element. For one thing, this lowers the costs for spare parts during the operation of a disc screen device and it also allows a faster repair since the replacement of a cleaning finger can be carried out more quickly than the replacement of an entire screen element.

In a manner according to the invention, it can especially be provided that the at least one cleaning finger, at least at its radial end, is structured homogeneously and/or is made of a uniform material and/or of a uniform material mixture. Among other things, this embodiment allows the cleaning finger to be produced inexpensively using a homogeneous and/or uniform solid material, or else it allows the cleaning finger to be produced by means of the injection molding method.

Accordingly, it should be pointed out that, as set forth in the present application, the term "cleaning fingers" also encompasses those cleaning fingers that are free of reinforcement parts and into which fine and ultra-fine particles, especially particles that are smaller than 3 mm, especially particles that are smaller than 2 mm, especially particles that are smaller than 1 mm, especially particles that are smaller than 0.1 mm and/or particles that essentially ensure that the cleaning finger is abrasion-proof but not stiff have been mixed into a base material.

In an embodiment that has especially good cleaning properties, it is provided that the at least one cleaning finger, at least at its radial end, consists of a material that has a greater stiffness than the other fingers. This ensures that even strongly adhering dirt is thoroughly and reliably scraped off.

In order to ensure an efficient screening function, in a special embodiment, it is provided that the rest of the screen element and/or the other fingers is or are made of an elastic plastic, especially rubber.

In order to ensure a good screening function and, at the same time, in order to ensure an efficient and thorough cleaning function, it can be provided that the free end of the cleaning finger is at a greater radial distance from the axis of rotation than the other fingers are. For one thing, this achieves that the other fingers do not wear out prematurely due to friction against the other screen elements, but rather that the one cleaning finger thoroughly and reliably scrapes off dirt and impurities. As an alternative or additionally, it can be provided that the center of the outer contour of the fingers is arranged eccentrically relative to the axis of rotation of the screen element, whereby preferably the radial outer end of the cleaning finger is at the greatest radial distance from the axis of rotation of the screen element.

Additional objectives, advantages, features and application possibilities of the present invention can be gleaned from the description below of an embodiment making reference to the drawing. In this context, all of the described or illustrated features on their own or in any meaningful combination constitute the subject matter of the present invention; this also applies irrespective of their compilation in the patent claims and of the claims to which they refer back.

DESCRIPTION OF THE DRAWINGS

The following is shown.

DETAILED DESCRIPTION OF EMBODIMENTS

Figure 1:
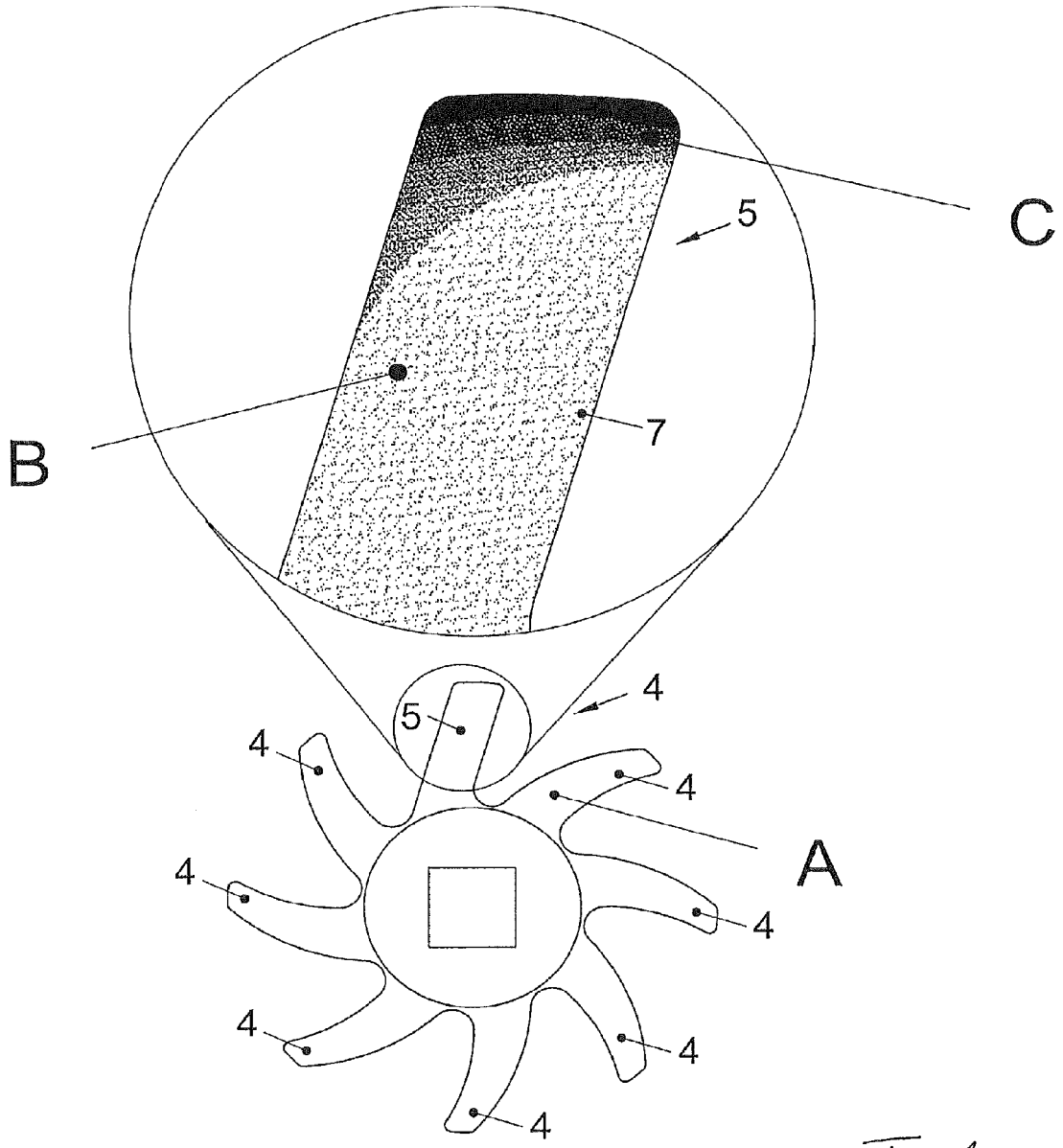
FIG. 1 a screen element according to the invention.

FIG. 1 shows a screen element according to the invention for a disc screen device that has elastically flexible fingers 4, whereby one of the fingers 4 is configured as a cleaning finger 5 for purposes of cleaning especially the collar of a screen element (not shown here) that is arranged on the adjacent axis of rotation and/or on one adjacent axis of rotation. In an enlarged view, FIG. 1 shows that the at least one cleaning finger 5, at least at its radial end 7, is made of a uniform and abrasion-proof material and is structured homogeneously.

Figure 2:
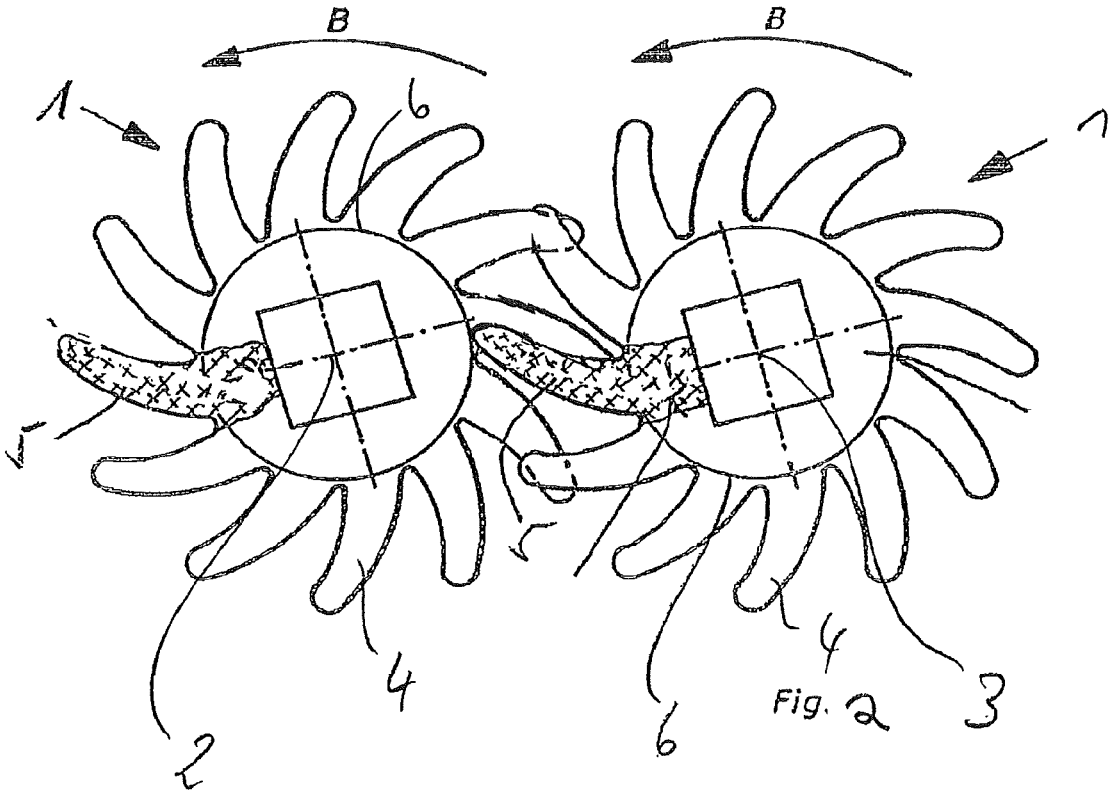
FIG. 2 a detailed section of a disc screen device according to the invention that is fitted with the screen elements according to the invention.

FIG. 2 shows a detailed view of a disc screen device according to the invention having two screen elements 1 according to the invention that are each arranged non-rotatably on adjacent axes of rotations 2, 3 arranged parallel to one another. Each of the screen elements 1 is fitted with a replaceable cleaning finger that is structured homogeneously in its entirety and that is made of an abrasion-proof material.

LIST OF REFERENCE NUMERALS

1 screen element
2 axis of rotation
3 axis of rotation
4 finger
5 cleaning finger
6 collar
7 radial end of the cleaning finger 5

The invention claimed is:

1. A screen element for a disc screen device, comprising:

a first screen element configured for rotation about a first axis, a second screen element configured for rotation about a second axis that is spaced apart from and oriented parallel or substantially parallel to the first axis, a first plurality of elastically flexible fingers of elastomeric material extending radially outwardly from the first screen element, a second plurality of elastically flexible fingers of elastomeric material extending radially outwardly from the second screen element, and at least one cleaning finger extending radially outwardly from either the first screen element or the second screen element, wherein the at least one cleaning finger, at least at its radial end is made of a different material from that of the rest of the screen element and from that of the other fingers.

2. The screen element for a disc screen device of claim 1, further comprising at least a second cleaning finger extending radially outwardly from either the first screen element or the second screen element.

3. The screen element for a disc screen device of claim 1, wherein the cleaning finger extends outwardly from the first screen element and wherein the cleaning finger at its radial end has a free end that is at a greater radial distance from the first axis than are free ends of the other fingers of the first plurality of elastically flexible fingers.

4. The screen element for a disc screen device of claim 1, where the cleaning finger extends outwardly from the first screen element, and wherein the fingers of the first plurality of fingers define a center at an outer contour, and the center of the outer contour of the fingers of the first plurality is arranged eccentrically relative to the first axis, and wherein a radial outer end of the cleaning finger is at a greatest radial distance from the first axis.

5. A disc screen device comprising a screen element (1) which has a plurality of axes of rotation (2, 3) oriented parallel to one another, on each of which axes of rotation (2, 3) a plurality of screen elements (1) are spaced axially from one another and are rotatably arranged, wherein each screen element (1) has elastically flexible fingers (4) of elastomeric material, wherein a cleaning finger (5) of elastomeric material is adapted for cleaning the collar (6) of a screen element (1) and is arranged on at least one of the adjacent axis of rotation (2, 3), characterized in that the at least one cleaning finger (5) at its radial end, comprises a material that has a greater stiffness than material forming the other fingers (4).

6. The screen device according to claim 5, characterized in that the cleaning finger (5), at least at its radial end (7), is made of a different material from that of the rest of the screen element and from that of the other fingers (4).

7. The screen device according to claim 5, characterized in that the at least one cleaning finger (5), at least at its radial end, is made of an abrasion-proof material.

8. The screen device according to claim 5, characterized in that the at least one cleaning finger (5), at least at its radial end, is made of a uniform material or of a uniform material mixture.

9. The screen device according to claim 5, characterized in that but for the at least one cleaning finger (5) or portion thereof, the rest of the screen element (1) is made of an elastomeric material.

10. The screen device according to claim 5, characterized in that the at least one cleaning finger (5), at least at its radial end (7), is made of a material selected from the group consisting of: an abrasion-proof plastic, a polyimide a polyvinyl chloride a polyester urethane rubber, and a mixture of abrasion-proof plastics.

11. The screen device according to claim 5, characterized in that the at least one cleaning finger (5), at least at its radial end (8), is made of a material selected from the group consisting of: metal, a metal alloy, a steel, a steel alloy, a tempered steel, a tempered steel alloy, and fine-grained steel.

12. The screen device according to claim 5, characterized in that the at least one cleaning finger (5), at least at its radial end (8), is made of a ceramic material.

13. The screen device according to claim 5, characterized in that the cleaning finger (5) at its radial end has a free end that is at a greater radial distance from the axis of rotation (2, 3) than are free ends of the other fingers (4).

14. The screen device according to claim 5, characterized in that the entire cleaning finger (5) is made of an abrasion-proof material.

15. The screen device according to claim 5, characterized in that the cleaning finger (5) is removably fastened to the rest of the screen element.

16. The screen device according to claim 5, characterized in that the fingers (4, 5) define a center at an outer contour, and the center of the outer contour of the fingers (4, 5) is arranged eccentrically relative to the axis of rotation (3) of the screen element (1), wherein a radial outer end (7) of the cleaning finger (5) is at a greatest radial distance from the axis of rotation (3) of the screen element (1).

17. The screen device according to claim 5, wherein but for the at least one cleaning finger (5) or portion thereof, the rest of the screen element (1) is made of rubber.

* * * * *